US005699686A

United States Patent [19]

Neumayer et al.

[11] Patent Number: 5,699,686

[45] Date of Patent: Dec. 23, 1997

[54] DEVICE FOR ELECTROMAGNETICALLY SECURING A LOCK BARREL

[75] Inventors: Harald Neumayer; Roland Krewenka, both of Vienna, Austria

[73] Assignee: EVVA-Werk Spezialerzeugung von Zylinder- und Sicherheitsschlossern Gesellschaft m.b.H. & Co., Vienna, Austria

[21] Appl. No.: 600,978

[22] PCT Filed: Jun. 30, 1995

[86] PCT No.: PCT/AT95/00139

§ 371 Date: Feb. 22, 1996

§ 102(e) Date: Feb. 22, 1996

[87] PCT Pub. No.: WO96/00830

PCT Pub. Date: Jan. 11, 1996

[30] Foreign Application Priority Data

Jun. 30, 1994 [AT] Austria ..... 1294/94

[51] Int. Cl.[6] ..... E05B 47/06

[52] U.S. Cl. ..... 70/283; 70/276

[58] Field of Search ..... 70/283, 276–282

[56] References Cited

U.S. PATENT DOCUMENTS

| | | | |
|---|---|---|---|
| 3,935,720 | 2/1976 | Böving | 70/276 |
| 3,967,846 | 7/1976 | Schlage | 70/283 X |
| 4,625,848 | 12/1986 | Meyers et al. | 70/283 X |
| 5,010,750 | 4/1991 | Böser et al. | 70/283 X |
| 5,542,274 | 8/1996 | Thordmark et al. | 70/283 X |
| 5,561,997 | 10/1996 | Milman | 70/283 |

FOREIGN PATENT DOCUMENTS

| | | | |
|---|---|---|---|
| 0281507 | 9/1988 | European Pat. Off. . | |
| 2249228 | 5/1975 | France . | |
| 2542794 | 9/1984 | France . | |
| 2596447 | 10/1987 | France . | |
| 2609545 | 7/1988 | France . | |
| 3902992C1 | 3/1990 | Germany . | |
| 671800A5 | 9/1989 | Switzerland . | |
| 2211239 | 6/1989 | United Kingdom | 70/283 |

*Primary Examiner*—Lloyd A. Gall
*Attorney, Agent, or Firm*—Nixon & Vanderhye P.C.

[57] ABSTRACT

The device for electromagnetically blocking the closing cylinder (2) of a lock (1) includes a rotary drive comprising a coil (12) and a rotor (7). Depending on the rotary position of the rotor (7), the movable tumbler (4) may be disengaged from the recess (3) of the locking cylinder. In the blocking position, disengagement is prevented by abutment on the end face (11) of the rotor. (FIG. 1 )

8 Claims, 3 Drawing Sheets

DEVICE FOR ELECTROMAGNETICALLY SECURING A LOCK BARREL

TECHNICAL FIELD

The invention relates to a device for electromagnetically blocking the closing cylinder of a lock, comprising at least one movable tumbler engaging in a recess provided on the circumference of the closing cylinder.

BACKGROUND

In respect of closing cylinders, there have already become known electronic closing cylinders in which a movable tumbler is placed into a locking position or is disengaged from such locking position by an electromagnetic drive. In a particularly simple manner, an electromagnetic drive in that case may be designed as a lifting drive, such a design yet having the disadvantage of being relatively largely prone to failures. Whenever a movable tumbler is to be actuated by magnetic forces, sufficient movability of the movable tumbler is to be safeguarded and there is the risk of the locking position of such a movable tumbler being released under mechanical influences, for instance by striking at the cylinder, safety thus being no longer ensured.

SUMMARY OF THE INVENTION

The invention aims at providing a device of the initially defined kind, in which safe blocking may be effected by means of an extremely small electromagnetic drive and cannot be readily undone again even under the influence of shocks or other mechanical or electromagnetic actions on the locking cylinder. To solve this object, the device according to the invention essentially consists in that the movable tumbler cooperates with an electromagnetic rotary drive and in its closing position is secured against disengagement from the recess. By providing an electromagnetic rotary drive structurally similar to a conventional small-design motor and by using this rotary drive for preventing the movable tumbler from disengagement from its blocking position in a predetermined rotary position, a high degree of safety is ensured even at slight actuation forces. For, the actuation forces of the rotary drive merely need be adequate to place a support in its operating position, against which the movable tumbler can no longer be moved out. On the other hand, the actuation forces required for unblocking are limited to rotating the rotary drive in a manner that the movable tumbler may re-emerge from a recess into which is has been inserted in its closing position. Thus, the electromagnetic drive causes only the adjustment of a stop shoulder or supporting surface provided for the movable tumbler and, therefore, an extremely small-design and simple rotary drive applying only slight forces will do, but which nevertheless ensures a high degree of safety against mechanical influences. To enable unblocking and the disengagement of the movable tumbler, the configuration advantageously is devised such that the rotary drive enables the disengagement of the movable tumbler from the recess of the closing cylinder in a defined rotary position.

Particularly simple blocking and safe supporting of the movable tumbler may be realized in that the movable tumbler, about its circumference, comprises cantilevering projections or wings or the like and is resiliently pressed into the recess of the blocking cylinder, and that the end face of the rotary drive facing the movable tumbler in a defined rotary position of the rotary drive comprises recesses for receiving said projections or wings. Such a configuration allows for the use of a particularly compact rotary drive, said configuration advantageously being devised such that the rotary drive comprises a stator constituted by a coil spooled on the generated surface of a cylinder in the direction z, and a rotor magnetized in the direction x, in particular a tube- or sleeve-shaped rotor. The tube- or sleeve-shaped design of the rotor allows for the arrangement of a spring for resiliently pressing the movable tumbler and, furthermore, allows said movable tumbler to be pressed into the central cavity of the rotor unless the projections or wings are prevented from immersing into the rotor by an appropriate stop surface.

In order to make the movable tumbler readily evade upon release of the stroke or course of the movable tumbler against the force of a spring, the configuration advantageously is devised such that the recess comprises oblique surfaces on the circumference of the closing cylinder, via which the movable tumbler is slidingly guided radially outwards as the closing cylinder is rotated upon enabling of the disengagement movement by the rotary drive. Such a configuration causes the movable tumbler to be slidingly pressed outwards via the oblique surfaces with the movable tumbler being able to immerse into the interior of the sleeve- or tube-shaped rotor and the wings or projections being able to immerse into respective recesses provided on the end side of the rotor.

In order to offer, with such a configuration, the additional advantage of automatically assuming a defined starting position as the device gets currentless again, the configuration advantageously is devised such that at least one stationarily arranged element magnetic in the longitudinal direction, e.g., a ferrite, is provided in addition, setting the magnetized rotor in a defined rotary position in the absence of current at the coil. Such a configuration, upon resilient readjustment of the movable tumbler into its blocked position, allows for the automatic rotation of the rotor into a defined starting position, in which the stop surfaces again enter into effect with a view to supporting the projections or wings of the movable tumbler, thus preventing further rotation of the closing cylinder, since from then on the movable tumbler cannot evade any more.

As already mentioned, the configuration in an advantageous manner is devised such that the end face of the rotor includes recesses in the form of slots for receiving the projections or wings of the movable tumbler, wherein such recesses may, for instance, be designed in the manner of screw driver grooves matching in contour with corresponding plug wings in order to enable the evasion of the plug in the respective rotary position of the rotor. As further pointed out in the beginning, it is feasible, in particular due to the tube- or sleeve-shaped design of the rotor, to arrange a spring in the interior of the rotor coaxial therewith such that, on the whole, a particularly compact and simple construction is provided, which may readily be installed in a conventional lock of usual contour. Thus, blocking is effected by a rotary drive causing two or four connections. With two connections, rotation by 90° from the resting position is provided in consideration of the given field lines, wherein the rotor will orient itself in accordance with a rigidly arranged magnetic part, e.g., ferrite, as the coil is no longer passed by current. When using more than one ferrite, also a bistable state may be obtained, in which one of two possible end positions may be assumed facultatively, which end position renders feasible either the release or the blocking of the movement of the locking plug. When using a coil having four poles offset by 90°, with opposite poles each belonging together, the field of the ferrite need not be overcome for rotary movement. However, in that case constant current is required since there will be no stable resting position at a power breakdown.

A particular advantage of the configuration according to the invention consists in that external influence or manipulation appears to be hardly possible on account of the rotary movement demanded from the supporting surfaces. Moreover, hardly moved parts cause little wear of the structural components, each of which structural components, due to the particularly slight number of structural components, even may be realized accordingly more sturdy.

In the following, the invention will be explained in more detail by way of exemplary embodiments schematically illustrated in the drawing.

DETAILED DESCRIPTION OF THE DRAWINGS

Figure 1:
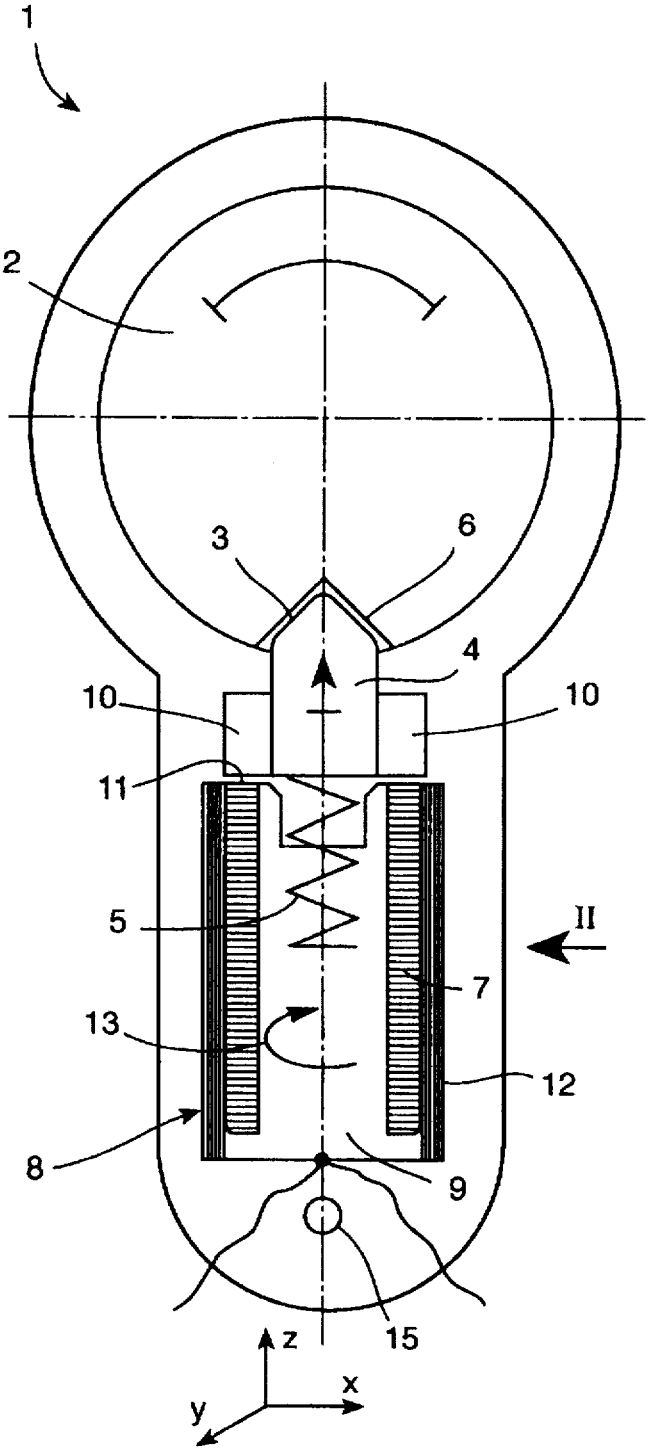
FIG. 1 is a schematic view of a lock comprising the electromagnetic blocking device according to the invention.

From FIG. 1 a lock 1 is apparent, whose closing cylinder 2 on its circumference has a recess 3 for receiving a movable tumbler 4. The movable tumbler 4 is inserted in the recess 3 by the force of the spring 5. The recess 3 has oblique surfaces 6 cooperating with the movable tumbler 4. If the rotor 7 of the electromotor 8 is in the position represented in FIG. 1, evasion of the movable tumbler 4 into the hollow space 9 of the rotor 7 is impeded, since the lateral projections or wings 10 of the movable tumbler 4 collide with the end face 11 of the rotor 7. The coil of the electromotor 8 is indicated by 12, the windings of the coil being effected in the direction of the axis z. The rotor 7 is magnetized in the direction of the axis x, rotation of the rotor upon current feed thus taking place in the sense of arrow 13.

Figure 2:
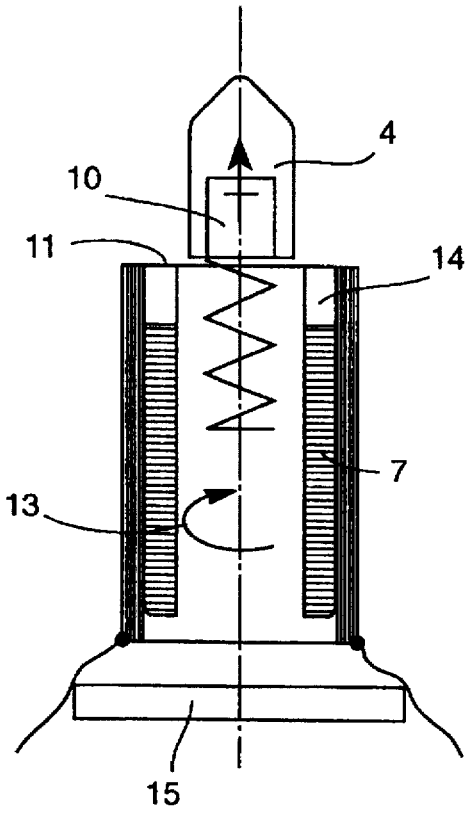
FIG. 2 shows a detail of FIG. 1 viewed in the direction of arrow II.

From the illustration according to FIG. 2, it is apparent that the end face 11 of the rotor 7 has recesses 14 in which the wings or lateral projections 10 of the movable tumbler 4 may engage upon appropriate rotation of the rotor 7 in the direction of arrow 13. In FIGS. 1 and 2, a stationary ferrite 15 is additionally visible, which causes the rotor 7 to rotate into a defined starting position in the absence of current at the coil 12.

Figure 4:
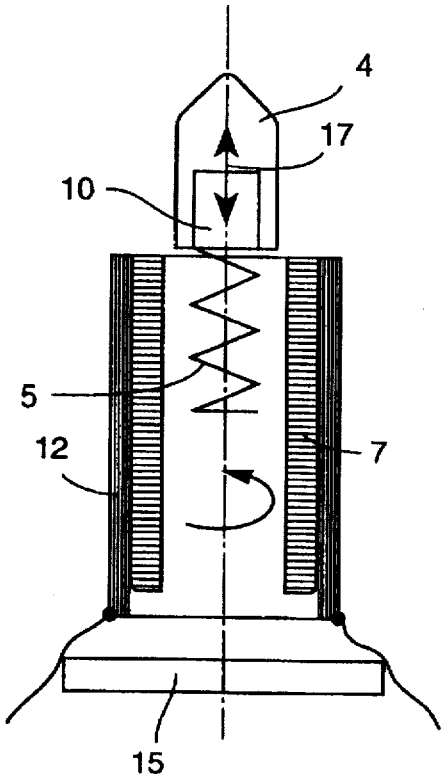
FIG. 4 is a partial view according to arrow IV of FIG. 3.
Figure 3:
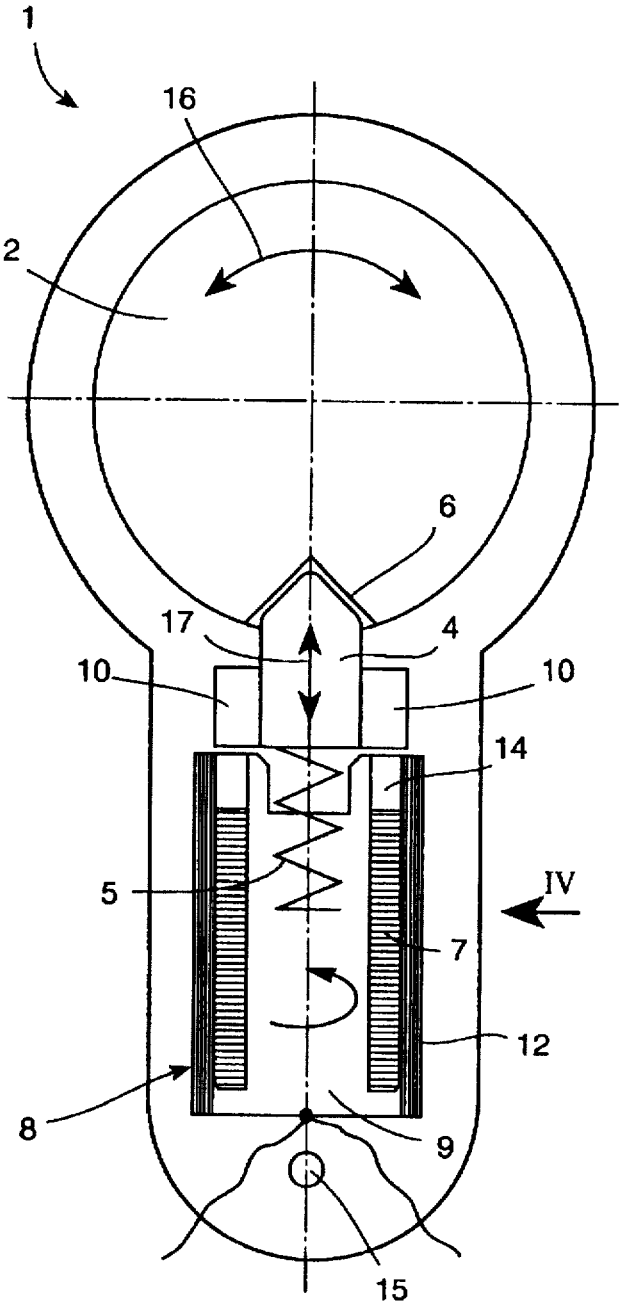
FIG. 3 is an illustration analogous to FIG. 1 with the rotor rotated by 90°.

In the illustrations according to FIGS. 3 and 4, a position rotated by 90° is each visible, which position will be assumed if current is flowing through the coil 12. As is apparent, in particular, from FIG. 3, the lateral projections 10 of the movable tumbler 4 are able to immerse into the recesses 14 of the rotor 7 in that rotary position with the force of the spring 5 having to be overcome. When turning the blocking cylinder in the direction of double arrow 16, the oblique surfaces 6 will act on the movable tumbler 4 in the sense of an axial displacement in the direction of double arrow 17 so as to enable the engagement of the movable tumbler 4 in the central axial hollow space 9 of the rotor. The respective side view according to arrow IV, on the coil and rotor again is represented in FIG. 4.

Figure 5:
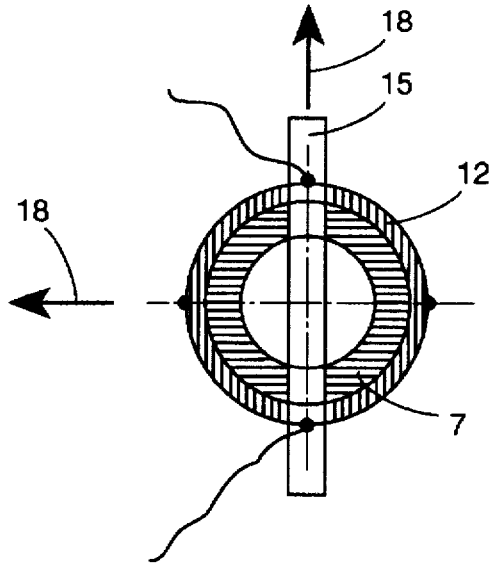
FIG. 5, FIG. 6 and FIG. 7 depict variants of the configuration using a ferrite for automatically assuming a defined starting position in the absence of current at the coil.
Figure 6:
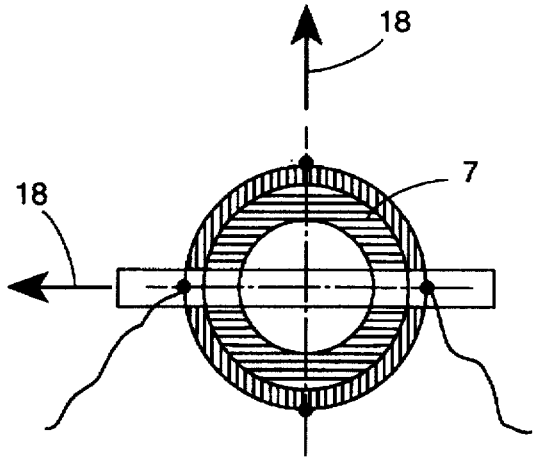
Figure 7:
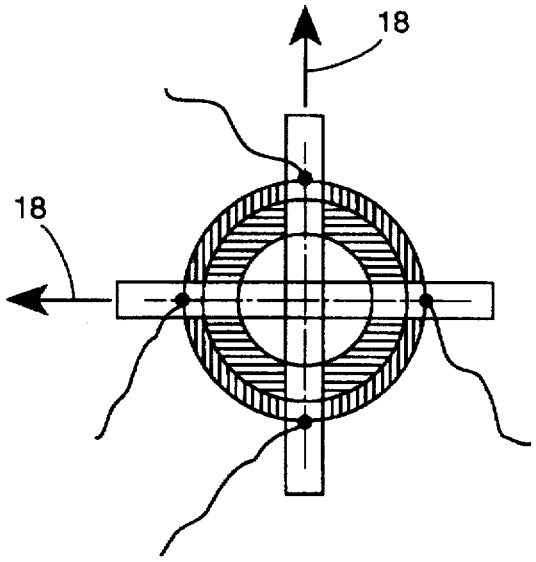

From the illustrations according to FIGS. 5, 6 and 7, different arrangements of ferrites 15 can each be taken. The magnetizing direction of the rotor in those cases corresponds to one of the arrows 18, depending on whether the coil 12 is currentless or not. In the representation according to FIG. 7, bistable blocking is feasible, one of the two positions indicated by arrows 18 being assumed in the absence of current. The end points of the ferrites each lie beyond the poles of the coils. With the configuration according to FIG. 7, the coil merely is used for switching over from one stable position into the other, whereby a particularly low current consumption is achieved, since constant current feed is no longer necessary. With the configurations according to FIGS. 5 and 6, a suitable constant current is each required for blocking or unblocking.

We claim:

1. A lock comprising a closing cylinder rotatable about a first axis, said closing cylinder having a recess in a circumferential surface thereof; a tumbler movable into and out of said recess along a second axis substantially perpendicular to said first axis and an electromagnetic rotary drive comprising a rotor for allowing movement of said tumbler into and out of said recess, said rotor arranged to rotate about said second axis.

2. A lock according to claim 1, wherein the rotary drive in a defined rotary position enables disengagement of the movable tumbler from said recess in said closing cylinder.

3. A lock according to claim 1, wherein said movable tumbler is formed with cantilevering projections about a circumference thereof, said tumbler resiliently pressed into said recess of the closing cylinder, and wherein an end face of the rotor facing the movable tumbler in a defined rotary position of the rotary drive comprises recesses for receiving said projections.

4. A lock according to claim 3, wherein said end face of the rotor includes recesses in the form of slots for receiving the projections of the movable tumbler.

5. A lock according to claim 1, wherein said recess comprises oblique surfaces by which the movable tumbler is slidingly guided radially outwards as the closing cylinder is rotated upon enabling of a disengagement movement by the rotary drive.

6. A lock according to claim 1, wherein the rotary drive further comprises a stator constituted by a coil elliptically spooled on a generated surface of a cylinder, and wherein said rotor is magnetized in a direction perpendicular to said second axis.

7. A lock according to claim 6, wherein at least one stationarily arranged magnetic element magnetizes the rotor in a defined rotary position absent current at the coil.

8. A lock according to claim 1, wherein a spring is arranged coaxial with the rotor and biases the movable tumbler toward the recess in the closing cylinder.

* * * * *